US005308255A

United States Patent [19]

Yamanashi

[11] Patent Number: 5,308,255

[45] Date of Patent: May 3, 1994

[54] CONNECTOR ASSEMBLY OF LOW INSERTION FORCE TYPE

[75] Inventor: Makoto Yamanashi, Shizuoka, Japan

[73] Assignee: Yazaki Corporation, Tokyo, Japan

[21] Appl. No.: 47,286

[22] Filed: Apr. 19, 1993

[30] Foreign Application Priority Data

Apr. 21, 1992 [JP] Japan ..... 4-100996

[51] Int. Cl.[5] ..... H01R 13/00

[52] U.S. Cl. ..... 439/157

[58] Field of Search ..... 439/152-160

[56] References Cited

U.S. PATENT DOCUMENTS 3,534,320 10/1970 Rushing ..... 439/157
5,104,330 4/1992 Yagi et al. ..... 439/157
5,135,410 8/1992 Kawase et al. ..... 439/157
5,169,327 12/1992 Hatagishi ..... 439/157
5,178,553 1/1993 Hatagishi .

FOREIGN PATENT DOCUMENTS 3-4672 1/1991 Japan .

*Primary Examiner*—Joseph H. McGlynn
*Attorney, Agent, or Firm*—Sughrue, Mion, Zinn, Macpeak & Seas

[57] ABSTRACT

Disclosure is a connector assembly of low insertion force type comprising first and second pairs of connectors which can be engaged with each other with a low insertion force. A connector assembly comprises: a frame on which an engaging lever member having cam grooves is swingably provided; a pair of female connectors which are set in the frame in advance; and a pair of connectors which are engaged with the first pair of connectors, respectively. The male connectors have cam pins. The female connectors and the frame have guide slots into which the cam pins are inserted. The guide slots of the female connectors are aligned with the guide slots of the frame when the female connectors are set in the frame.

6 Claims, 10 Drawing Sheets

CONNECTOR ASSEMBLY OF LOW INSERTION FORCE TYPE

BACKGROUND OF THE INVNTION

1. Field of the invention

This invention relates to a connector assembly comprising a pair of connectors which are operated with an operating lever so that they are engaged with each other by a low insertion force (hereinafter referred to as "a connector assembly of low insertion force type", when applicable).

2. Description of the Prior Art

A conventional connector assembly of this type, as shown in FIG. 14, comprises a male connector a and a female connector f. In the male connector a, an engaging operating lever c is rotatably mounted on a supporting pin d between the male connector body and a protective board b. The lever c has a cam groove e (cf. FIG. 15).

The female connector f has a cam pin g on its surface. When the female connector is engaged with the male connector, first the cam pin g is allowed to go in the inlet of the cam groove e (cf. the part (A) of FIG. 16). When, under this condition, the operating lever c is turned, the cam pin g is driven by the cam groove e, so that the female connector f is moved towards the male connector (cf. the part (B) of FIG. 16). When the operating lever has been fully turned, the female connector f is completely engaged with the male connector a (cf. Japanese Unexamined Utility Application. Hei. 3-4672.

In the above-described conventional connector assembly, it is necessary to provide the operating lever for one of the male and female connectors in advance so that they are engaged with each other.

SUMMARY OF THE INVENTION

Accordingly, an object of this invention is to provide a connector assembly of low insertion force type which employs a frame with a lever, so that connectors with no engaging lever can be connected by a low insertion force, and which can be set at a predetermined position with the aid of the frame with the lever.

The foregoing object of the invention has been achieved by the provision of a connector assembly of low insertion force type, which, according to the invention, comprises: a frame on which an engaging lever member having cam grooves is swingably provided; a first pair of connectors which are set in the frame in advance; and a second pair of connectors which are engaged with the first pair of connectors, the second pair of connectors having cam pins, the first pair of connectors and the frame having guide slots into which the cam pins are inserted, the guide slots of the first pair of connectors being aligned with the guide slots of the frame when the first pair of connectors are set in the frame.

In engaging the second pair of connectors with the first pair of connectors which have been set in the frame, the lever member is swung to pull in the second pair of connectors with the aid of the cam pins being engaged with the cam grooves.

The anther object of the invention has been achieved by the provision of a connector assembly of low insertion force type, which, according to the invention, comprises: a frame on which an engaging lever member having cam grooves is swingably provided; a first connector which is set in the frame in advance; and a second is engaged with the first pair of connector, the second connector having cam pins, the first connector and the frame having guide slots into which the cam pins are inserted, the guide slots of the first connector being aligned with the guide slots of the frame when the first connector is set in the frame.

In engaging the second connector with the first pair of connector which have been set in the frame, the lever member is swung to pull in the second pair of connector with the aid of the cam pins being engaged with the cam grooves.

Figure 16A:
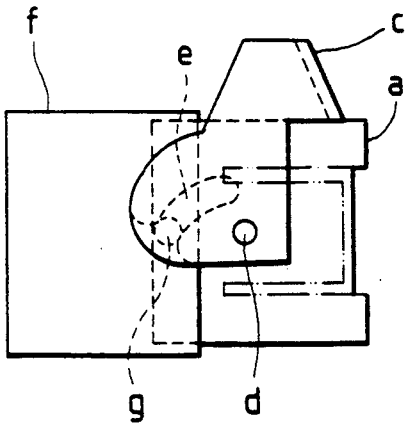
Figure 16B:
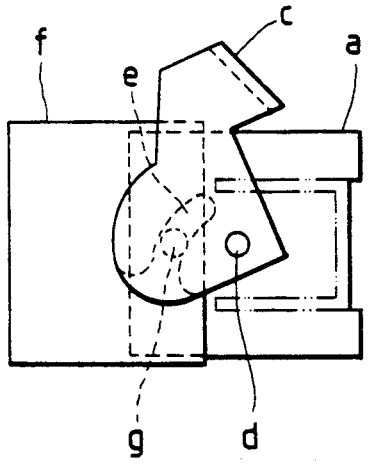
Figure 16C:
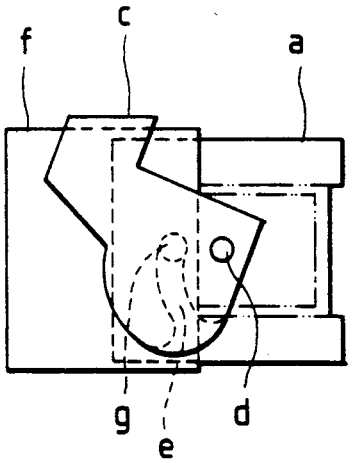

The parts (A), (B) and (C) of FIG. 16 are side views for a description of a method of joining the male and female connectors together.

DETAILED DESCRIPTION OF THE PREFERRED EMBODIMENTS

Prefered embodiment will be now described with referece to accompany drawings. In following embodiment, the present invention is applied to a pair type connector assembly.

Figure 1:
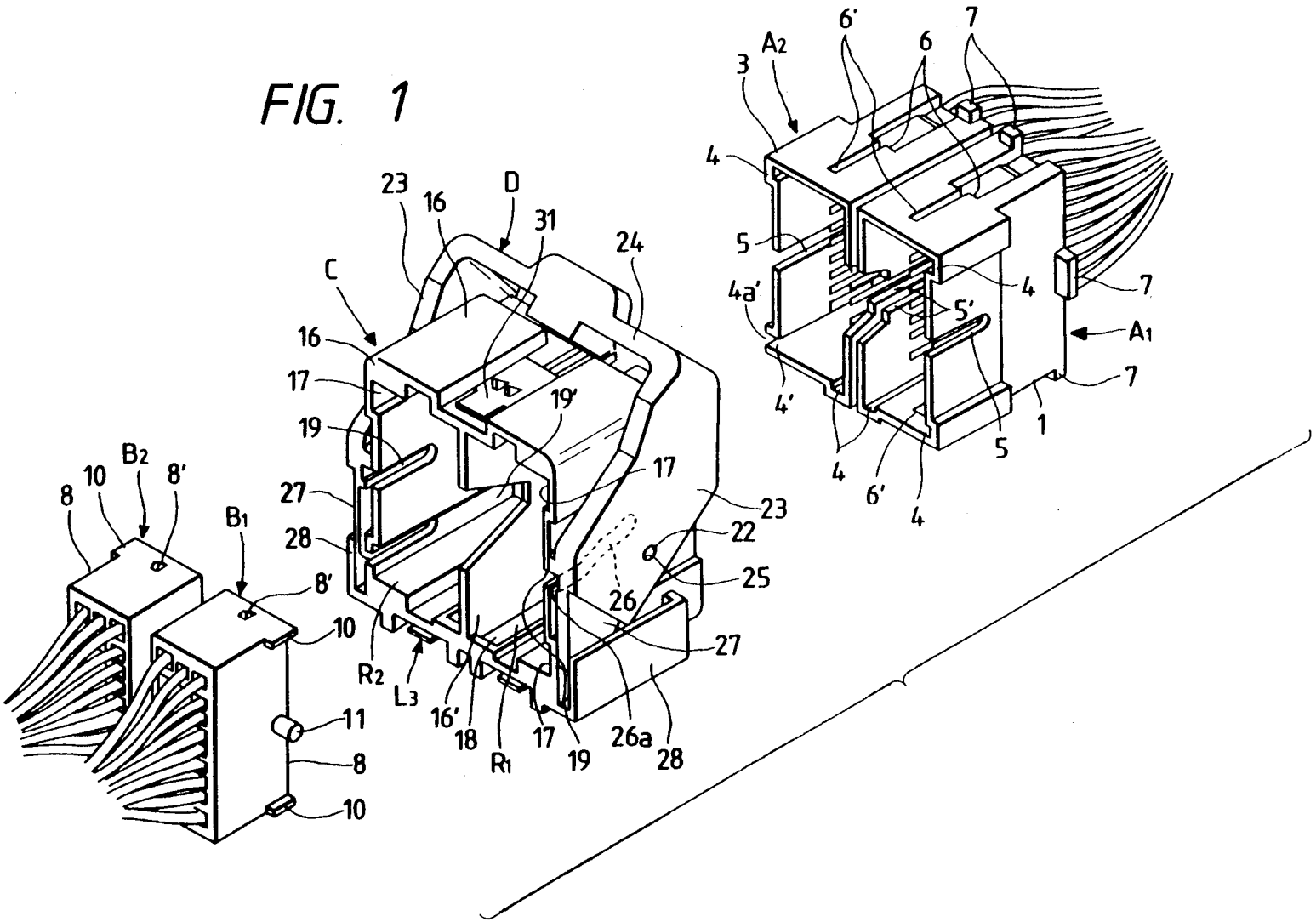
FIG. 1 is an exploded perspective view showing the arrangement of an example of a connector assembly of low insertion force type according to this invention.
Figure 3:
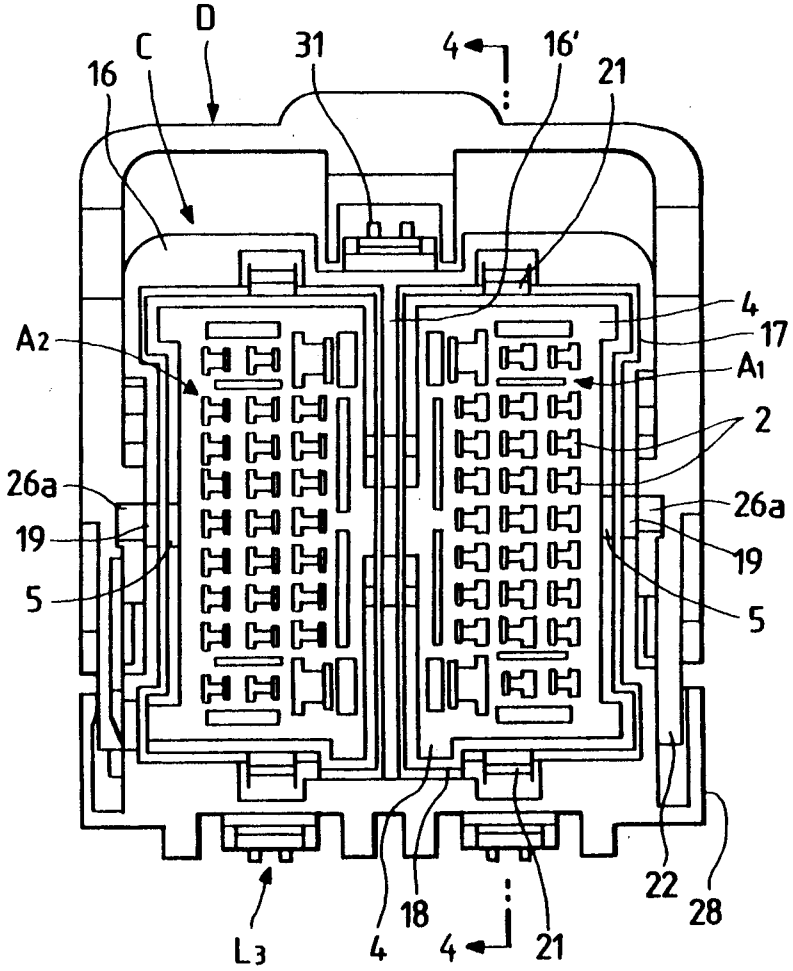
FIG. 3 is a front view of the lever-operated frame in which a pair of female connectors have been set.

FIG. 1 is an exploded perspective view showing a connector assembly of low insertion force type according to the invention. In FIG. 1, reference characters $A_1$ and $A_2$ designate a pair of female connectors; and $B_1$ and $B_2$, a pair of male connectors; and C, a frame with a lever (hereinafter referred to as "a lever-operated frame C", when applicable).

Figure 4:
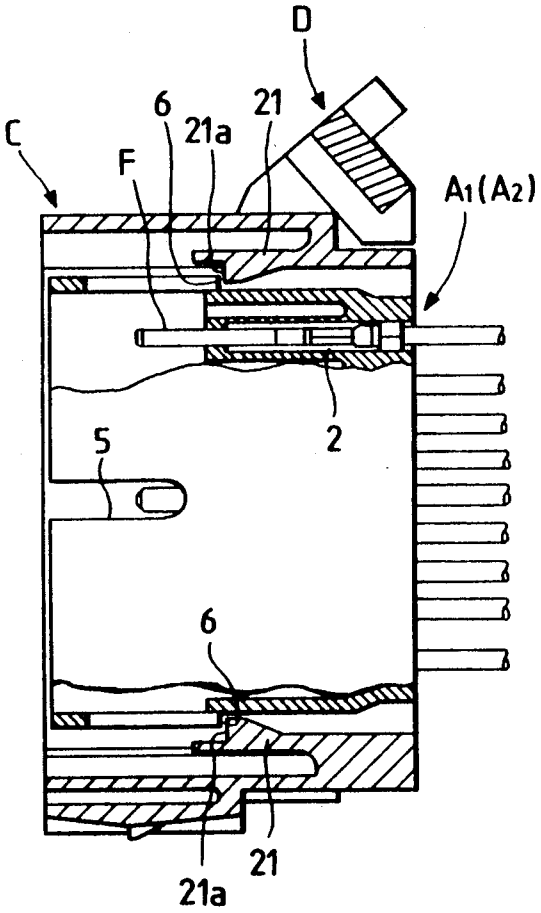
FIG. 4 is a sectional view taken along line X—X in FIG. 3.

The female connectors $A_1$ and $A_2$ have housings 1 of synthetic resin. Each of the housings 1 has a plurality of terminal accommodating chambers 2 inside it, into which male metal terminals F are inserted (cf. FIG. 4). The front portion of the housing 1 is formed into a cover portion 3. The cover portion 3 has accommodating portions 4 and 4' in its walls. The accommodating portions 4 and 4' are formed by expanding the walls outwardly in such a manner that they are extended in a front-to-rear direction, or axially. More specifically, one side wall of the cover portion 3 has the accommodating portions 4 along the upper and lower edges thereof, and the lower wall of the cover portion 3 has the accommodating portion 4' along the inner edge. The one side wall and the other side wall (opposed to the one side wall) have guide slots 5 and 5' at the middle, respectively, in such a manner that the slots 5 and 5' are extended axially in parallel with each other. The lower accommodating portion 4 of the female connector $A_2$ has a guide slot 4a' formed axially. The upper and lower walls of the housings 1 have engaging steps 6 and 6'. The engaging steps 6' are for the male connectors $B_1$ and $B_2$. Furthermore, each housing 1 has stoppers 7 which are extended upwardly and downwardly, respectively, and a stopper 7 extended sidewardly.

Figure 8:
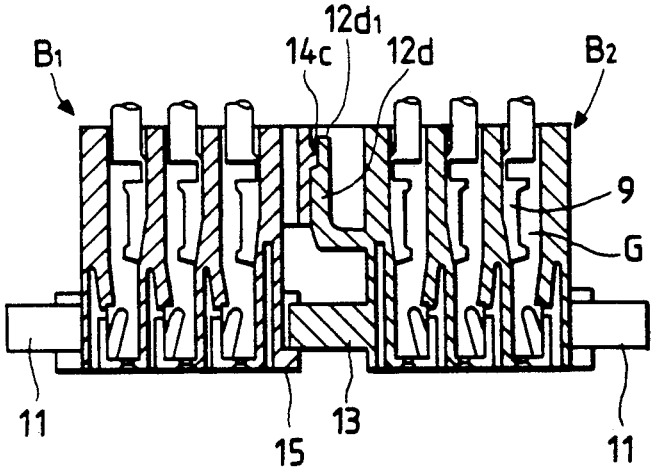
FIG. 8 is a sectional view taken along line Y—Y in FIG. 7.

The male connectors $B_1$ and $B_2$ also have housings 8 made of synthetic resin. Each of the housings 8 has a plurality of terminal accommodating chambers 9, in which female metal terminals G are accommodated (as shown in FIG. 8).

One side wall of each of the housings 8 has engaging regulating protrusions 10 which are extended axially along the upper and lower edges thereof, and the bottom wall has an engaging regulating protrusion 10' which is extended axially along the inner edge thereof. The one side wall further has a cam pin 11. The housings 8 have temporary locking protrusions 8' on the upper and lower walls in correspondence to the engaging slots 6' of the housings 1 of the female connectors $A_1$ and $A_2$, respectively.

Figure 6:
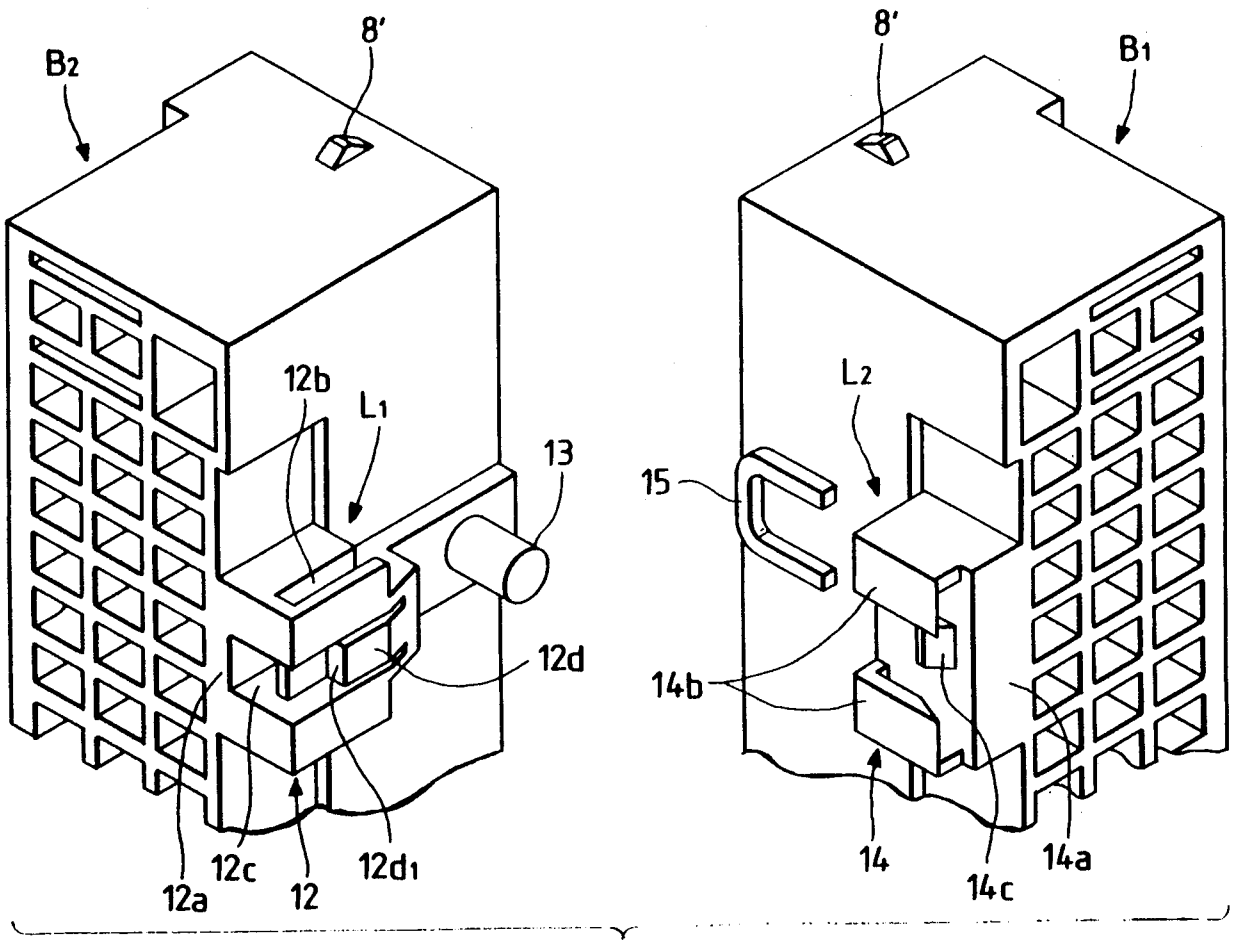
FIG. 6 is a perspective view showing the coupling structure of the pair of male connectors.
Figure 7:
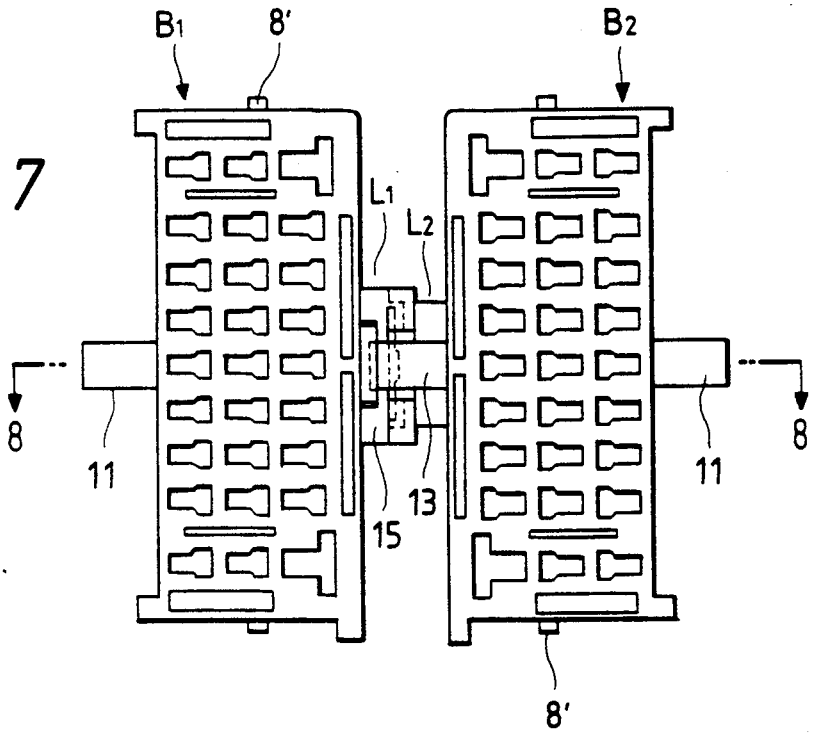
FIG. 7 is a front view showing the pair of male connectors which have been joined together.

The pair of male connectors $B_1$ and $B_2$ are joined together in advance. For this purpose, they have coupling portions $L_1$ and $L_2$, respectively (as shown in FIG. 6).

The coupling portion $L_1$ comprises a lock-coupling portion 12, and a space holding pin 13 located behind the latter 12. The lock-coupling portion 12 has a base 12a, in which a pair of engaging grooves 12b are formed in such a manner that one of the engaging grooves 12b is opened upwardly and backwardly, while the other is opened downwardly and backwardly. Furthermore, the base 12a has an intermediate slot 12c at the middle, in which a cantilevered flexible engaging piece 12d is provided.

The coupling portion $L_2$ is composed of a lock-coupling portion 14, and a pin receiving portion 15. The lock-coupling portion 14 has a base 14a, on which a pair of locking members 14b L-shaped in section are formed in such a manner that they are confronted with each other. In addition, a locking protrusion 14c is formed on the base 14a in such a manner that it is located between the locking members 14b.

The coupling portions $L_1$ and $L_2$ are joined together as follows: While the space holding pin 13 is being introduced into the pin receiving portion 15, the locking members 14b L-shaped in section of the coupling portion $L_2$ are inserted into the engaging grooves 12b of the coupling portion $L_1$ with the flexible locking piece 12d being bent. As the locking members are inserted into the engaging grooves in this way, the flexible locking pieces are restored, so that the locking step $12d_1$ of the flexible locking piece 12d is engaged with the locking protrusion 14c of the locking coupling portion 14. Thus, the coupling portions $L_1$ and $L_2$ have been joined together (cf. FIG. 8).

Figure 2:
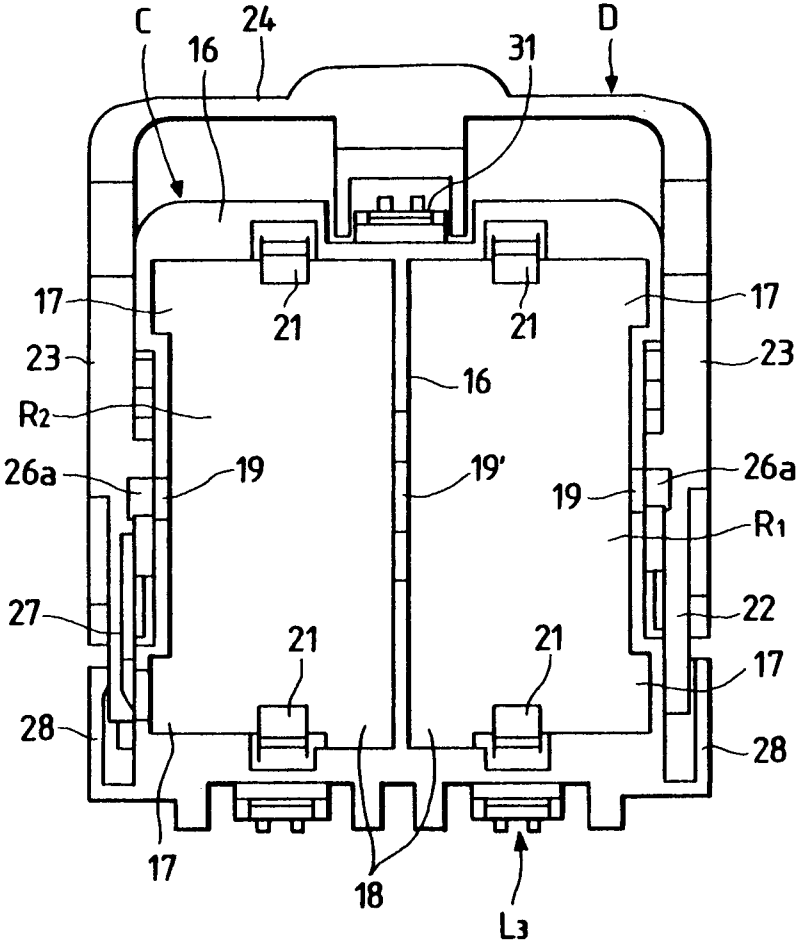
FIG. 2 is a front view of a lever-operated frame.
Figure 5:
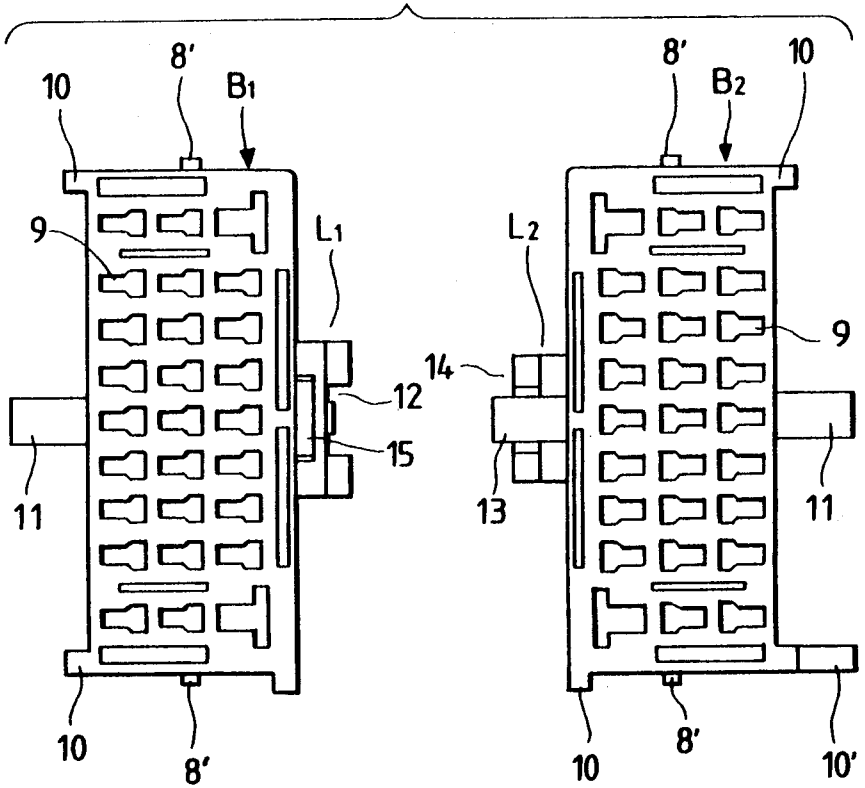
FIG. 5 is a front view showing a pair of male connectors.

The lever-operated frame C comprises a surrounding frame 16 of synthetic resin. The surrounding frame 16 has two chambers $R_1$ and $R_2$ with an intermediate wall 16' therebetween. Those chambers are extended in a front-to-rear direction, or axially. Accommodating recesses 17 are formed in the inner walls of two side walls of the surrounding frame 16, and an accommodating recess 18 is formed in the inner surface of the bottom wall. The two side walls of the surrounding frame 16 have guide slots 19 and 19, respectively, and the intermediate wall 16' has a guide slot 19'. Those guide slots 19 and 19' are extended axially. As shown in FIG. 2, cantilevered flexible locking pieces 21 having locking portions 21a at the free ends are integrally formed on the inner surfaces of the upper and lower walls of the two chambers $R_1$ and $R_2$. The two side walls have supporting shafts 11 at the middle.

An engaging lever member D is made up of a pair of levers 23 and 23 which are connected through a coupling plate 24; that is, it is substantially U-shaped. Each of the levers 23 has a shaft hole 25, and a cam groove 26 having an inlet 26a at one end. The lever member D is swingably mounted on the frame with the shaft holes 25 of the levers 23 engaged with the supporting shafts 22. The free end portions of the levers 23 are formed into thin engaging plates 27 and 27, which are slidably engaged with disengagement-preventing portions 28, respectively, which are integral with the bottom wall of the surrounding frame 16.

Figure 9:
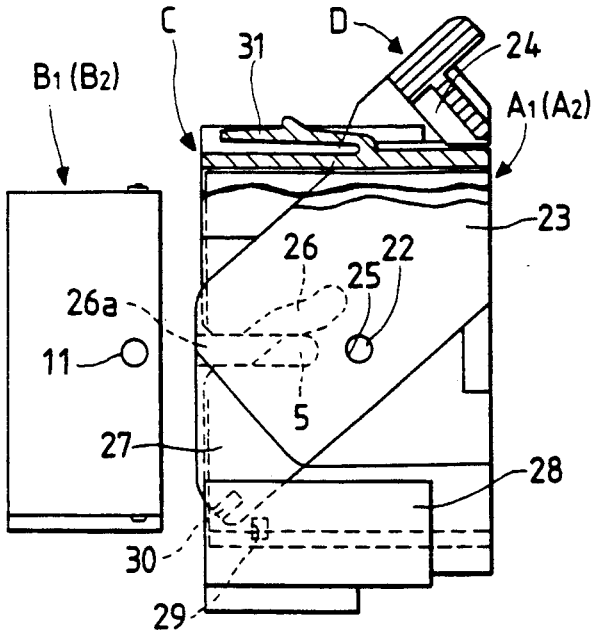
FIG. 9 is a side view showing the connector assembly in which the male connectors are not engaged with the female connectors with the lever-operated frame yet.

When the lever member D is at the non-operation position (cf. FIG. 9), temporary locking protrusions 29 formed on the side walls of the surrounding frame 16 are engaged with the temporary locking protrusions 30 of the engaging plates 27, so that the lever ember D is held stable there, and the cam openings meet the slit openings. In order to hold the lever member D at the operation position, flexible locking pieces 31 are provided on the upper wall of the surrounding frame 16.

In the connector assembly thus constructed, the female connectors $A_1$ and $A_2$ are accommodated in the chambers $R_1$ and $R_2$ of the surrounding frame 16 of the lever-operated frame C, respectively. That is, when the female connectors $A_1$ and $A_2$ are inserted into the surrounding frame 16 from behind until the stoppers 7 abut against the rear end of the surrounding frame 16, the flexible locking pieces 21 are engaged with the engaging steps 6, whereby the female connectors $A_1$ and $A_2$ are held at predetermined positions (cf. FIG. 4). In this operation, the guide slots 5 and 5' of the female connectors $A_1$ and $A_2$ align with the guide slots 19 and 19' of the surrounding frame 16, and therefore the open ends 26a of the cam grooves 26 of the lever member D meet the guide slots 5 and 19.

Figure 10:
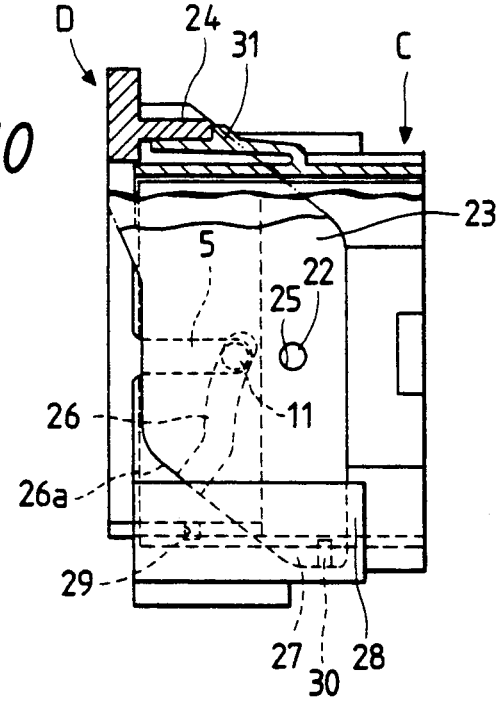
FIG. 10 is a side view showing the connector assembly in which the male connectors have been engaged with the female connectors with the lever-operated frame.

Under this condition, the pair of male connectors $B_1$ and $B_2$ joined together in advance are inserted into the female connectors $A_1$ and $A_2$ set in the lever-operated frame C until the temporary locking protrusions 8 are engaged with the engaging slots 6' while the cam pins 11 are set at the inlets of the cam grooves 26. Thereafter, the lever member D is turned, so that the male connectors $B_1$ and $B_2$ are pulled into the female connectors $A_1$ and $A_2$ with the aid of the cam pins 11 sliding into the cam grooves 26. Thus, the male connectors $B_1$ and $B_2$ have been engaged with the female connectors $A_1$ and $A_2$. When the lever member D has been fully turned, its coupling plate 24 is engaged with the flexible locking piece 31 (cf. FIG. 10).

Figure 11:
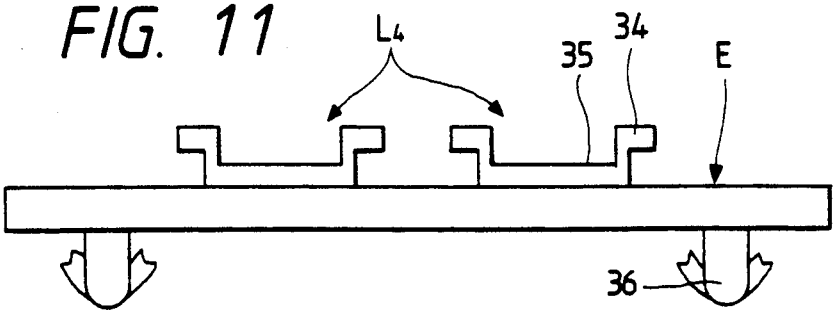
FIG. 11 is a front view of a mounting bracket.
Figure 12:
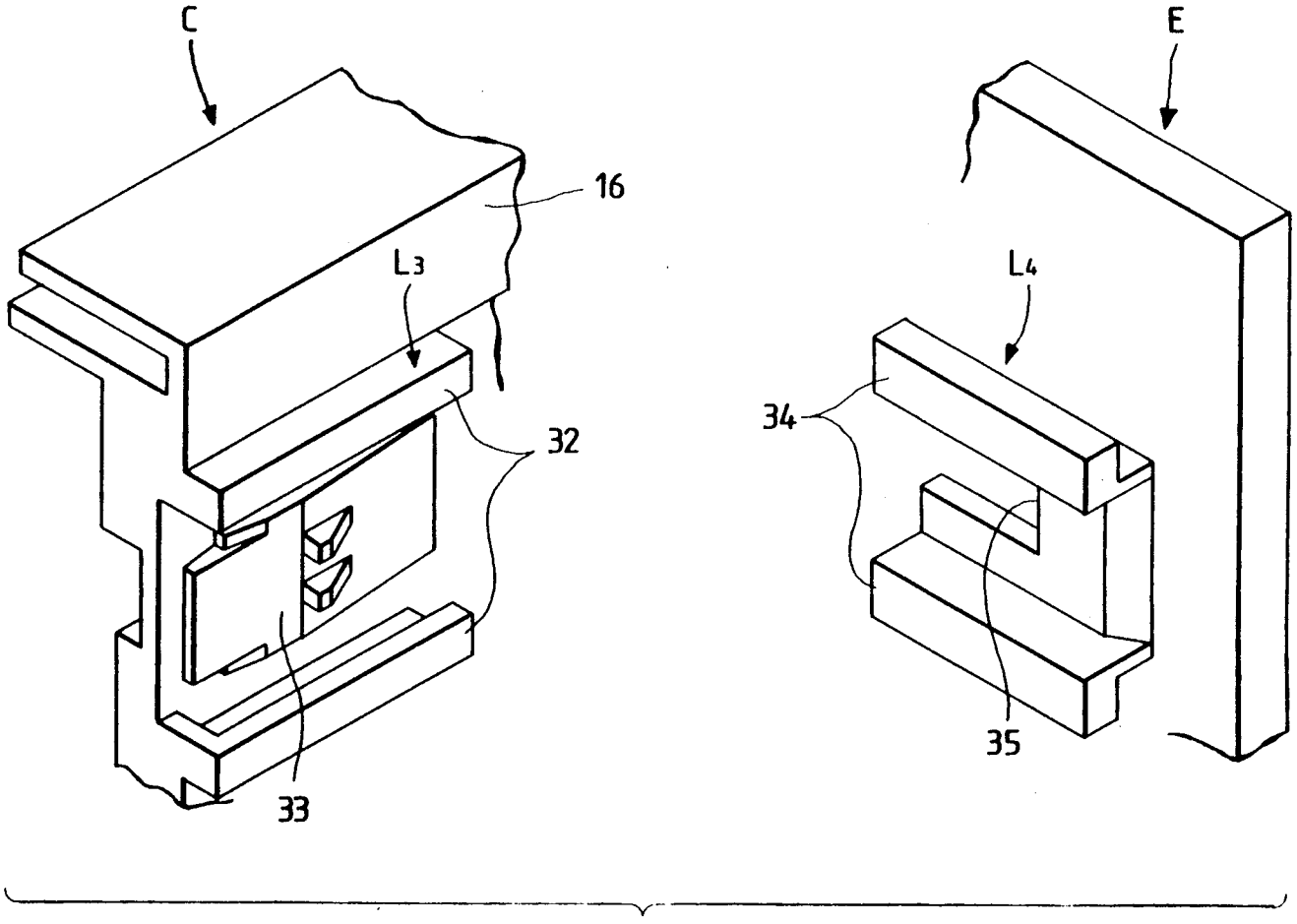
FIG. 12 is a perspective view showing the frame and the mounting bracket.

The lower wall of the surrounding frame 16 has coupling portions $L_3$ on the outer surface. Each of the coupling portions $L_3$ comprises a pair of locking members 32 L-shaped in section extended toward each other, and a cantilevered flexible locking piece 33. On the other hand, a mounting bracket E has coupling portions $L_4$, each of which comprises a pair of locking member 34 L-shaped in section which are extended outwardly, and an engaging step 35 located between them. The coupling portions $L_3$ are engaged with the coupling portions $L_4$, so that the mounting bracket E is fixedly secured to the surrounding frame 16. The mounting bracket E has elastic clips 36, which are engaged with the respective holes in the panel or the like (cf. FIGS. 11 and 12).

Figure 13:
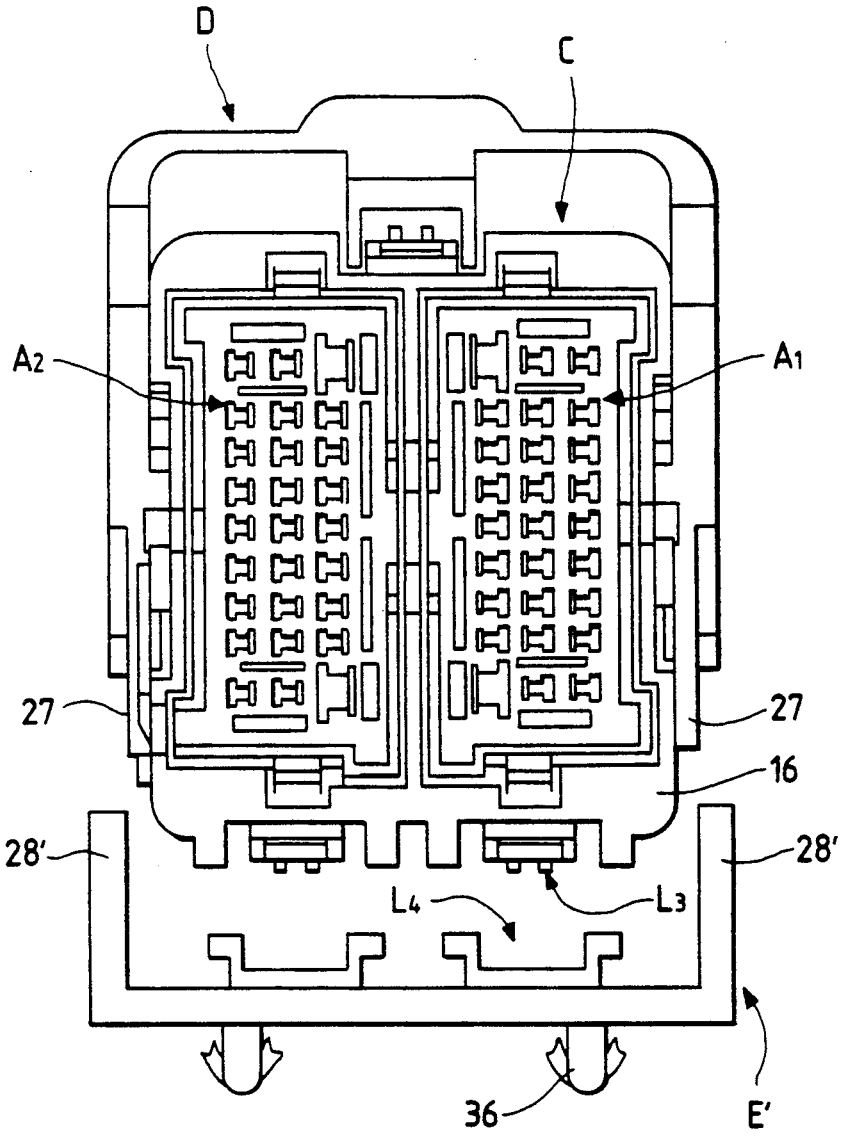
FIG. 13 is a front view showing another example of the mounting bracket.
Figure 14:
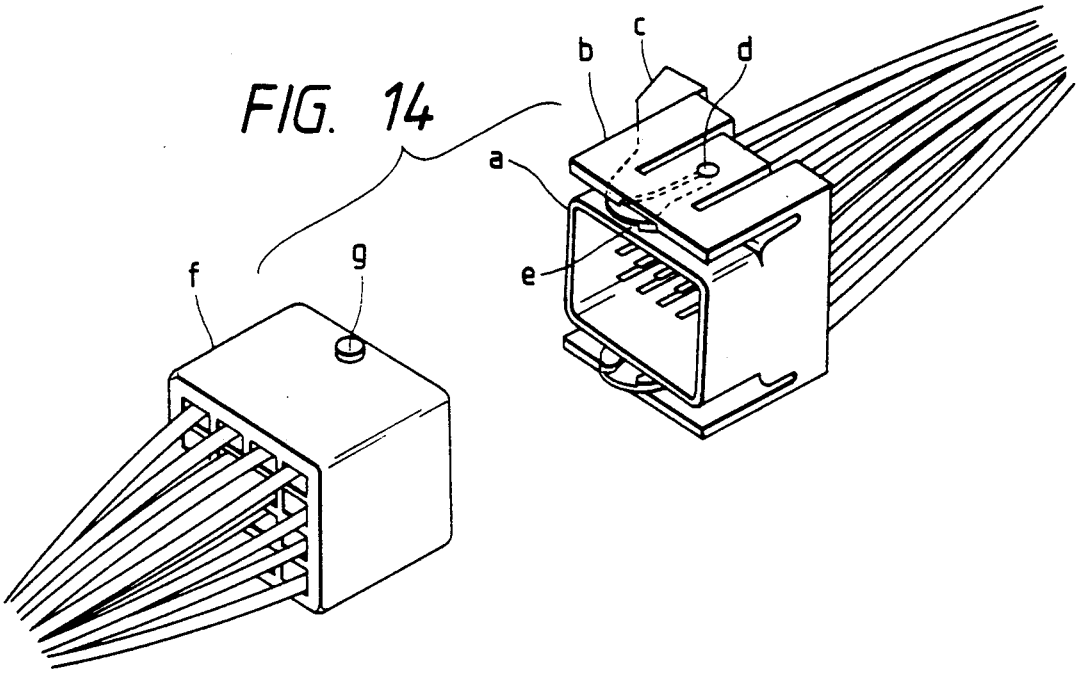
FIG. 14 is an exploded perspective view showing an example of a conventional connector assembly comprising male and female connectors.
Figure 15:
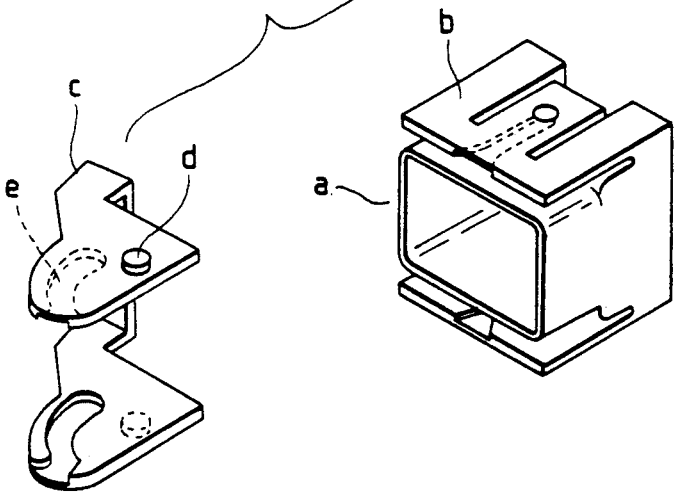
FIG. 15 is a perspective view showing one of the connectors in the conventional connector assembly, and an engaging lever disconnected from the connector.

FIG. 13 shows another example of the connector assembly according to the invention. In the connector assembly of FIG. 13, the disengagement-preventing portions 28 of the surrounding frame 16 is not employed, and instead its mounting bracket E has engagement-preventing portions 28' in correspondence to the engaging plates 27 of the lever member D. In the case of the connector assembly shown in FIG. 13, with the lever member D opened, the shaft holes 25 are engaged with the supporting shafts 22, and thereafter the mounting bracket E' is secured, so that the disengagement-preventing portions 28' are engaged with the engaging plates 27. Thus, the lever member D can be readily coupled to the surrounding frame 16.

As was described above, the connector assembly of the invention comprises: the frame on which the engaging lever member having the cam grooves is swingably provided ; the first pair of connectors which are is set in the frame in advance; and the second pair of connectors which are engaged with the first pair of connectors. The second pair of connectors have the cam pins. The first pair of connectors and the frame have the guide slots into which the cam pins are inserted. The guide slots of the first pair of connectors are aligned with the guide slots of the frame when the first pair of connectors set in the frame. Hence, the connectors having no engaging lever can be connected by a low insertion force. Furthermore, the provision of the mounting structure for the lever-operated frame permits the connector assembly to be held at a predetermined position.

What is claimed is:

1. A connector assembly, comprising:

a cam frame on which an engaging lever member having cam grooves is rotatably provided, said cam frame being provided with a surrounding frame having guide slots formed in two side walls of said surrounding frame and extending to a forward end thereof, said engaging lever including a pair of levers which are connected through a coupling plate;

a first connector including a plurality of metal terminal accommodating chambers and a cover portion having a pair of side walls on which accommodating recesses are respectively formed, said first connector being received by a rearward end of said cam frame; and a second connector including a plurality of metal terminal accommodating chambers, said second connector including supporting shafts thereon, said second connector being received by said forward end of said cam frame such that said supporting shafts are inserted into said accommodating recesses and said guide slots, respectively, wherein upon rotation of said lever in a predetermined direction said supporting shafts are received in said cam grooves so that said first and second connectors are slidably engaged with each other.

2. A connector assembly of low insertion force as claimed in claim 1, wherein said guide slots of said first connectors is aligned with said guide slots of said frame when said first connector is set in said frame.

3. The connector assembly of claim 1, wherein said engaging lever is removable from said cam frame.

4. A connector assembly of low insertion force as claimed in claim 1, wherein said first connector includes a pair of connector housings, and said second connector includes a pair of connector housings.

5. A connector assembly of low insertion force as claimed in claim 4, wherein said connector housings of said second connector includes coupling member for coupling said connector housings.

6. A connector assembly of low insertion force as claimed in claim 5, wherein said coupling member includes lock-coupling unit and a space holding pin.

* * * * *